United States Patent [19]

Rousseau et al.

[11] Patent Number: 4,932,381

[45] Date of Patent: Jun. 12, 1990

[54] DEVICE AND PROCESS OF VERIFICATION OF THE WIRING OF THE IGNITION PERFORMANCE MODULE

[75] Inventors: Christian Rousseau, Antony; Gérard Saint Leger, Villejuif, both of France

[73] Assignee: Regie Nationale des Usines Renault, Boulogne Billancourt, France

[21] Appl. No.: 293,105

[22] Filed: Jan. 3, 1989

[51] Int. Cl.[5] ..... F02M 51/00; F02M 39/00

[52] U.S. Cl. ..... 123/479; 364/431.11

[58] Field of Search ..... 123/479, 179 L, 494; 364/431.11, 431.04; 73/118.1

[56] References Cited

U.S. PATENT DOCUMENTS 4,748,566 5/1988 Sasaki et al. ..... 364/431.11
4,750,128 6/1988 Honda et al. ..... 364/431.11
4,785,771 11/1988 Ibaki et al. ..... 123/479
4,797,828 1/1989 Suzuki et al. ..... 123/479
4,805,576 2/1989 Aba et al. ..... 123/479
4,825,691 5/1989 Sekiguchi ..... 123/479

*Primary Examiner*—Raymond A. Nelli
*Attorney, Agent, or Firm*—Oblon, Spivak, McClelland, Maier & Neustadt

[57] ABSTRACT

The invention relates to a device of verification of the wiring of ignition performance module (2) of an electronic injection-ignition system for an internal combustion engine. It comprises a so-called test line (9) connected between module (2) and computer (1) of injection-ignition. Thanks to this device, a process of verification of the wiring is established having to detect successively the presence of an open circuit or a short circuit between ignition performance module (2) and its control circuit (8).

4 Claims, 5 Drawing Sheets

DEVICE AND PROCESS OF VERIFICATION OF THE WIRING OF THE IGNITION PERFORMANCE MODULE

The invention relates to a device and a process of verification of the wiring of the ignition performance module in an electronic ignition system and in an electronic injection-ignition system for an internal combustion engine.

In an electronic injection-ignition system for an internal combustion engine, the electronic ignition part which performs the same function as an electronic ignition system is a piece of equipment delivering, at the appropriate moment, a high voltage spark to the plug of the cylinder being considered. This piece of equipment comprises an ignition performance module carrying the coil, whose description will be given below, illustrated by FIG. 1.

A defect of the connection of this module which would not be diagnosed could cause a replacement of a correct module.

To avoid these wasteful replacements, the invention proposes a process of verification of the wiring of the ignition performance module, intended to detect open circuits or grounded short circuits on the control wire of the module.

For this purpose, the object of the invention is first a device of verification of the wiring of the ignition performance module of an electronic injection-ignition system in an internal combustion engine, a system comprising among others, a flywheel equipped with teeth on its periphery passing in front of a magnetic sensor connected to a computer assuring the computation of the ignition advance and the fuel injection time and sending a signal, indicative of the ignition advance, to the control circuit of the ignition performance module, characterized in that it comprises a so-called test line connecting the electric connection, which exists between the module and its control circuit, to a test input of the computer.

According to another characteristic of the invention, it also relates to a process of verification of the wiring of the ignition performance module of an electronic system of injection-ignition intended to detect first an open circuit between the module and its control circuit, then a short circuit between the module and the ground.

Figure 1:
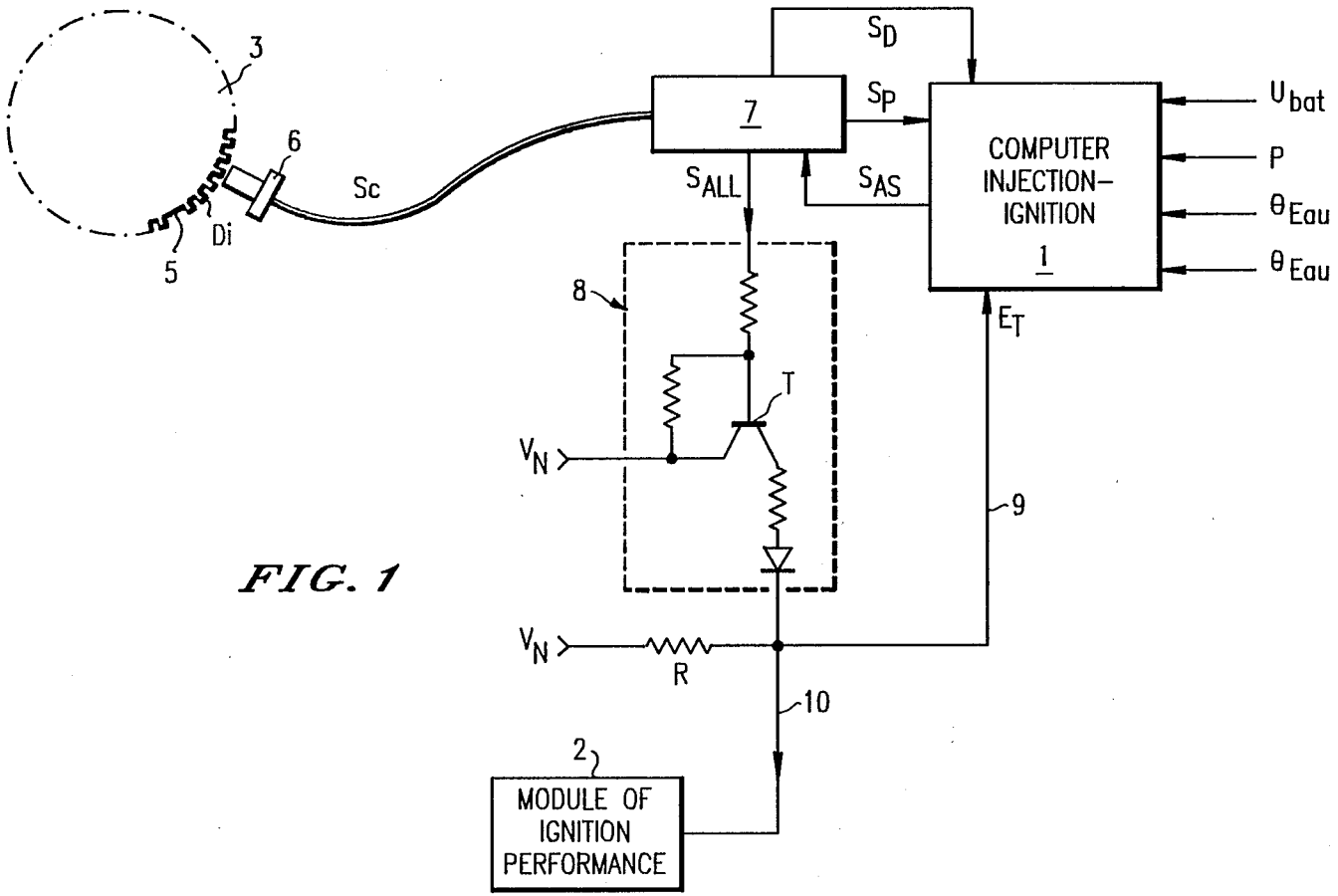
Figure 2:
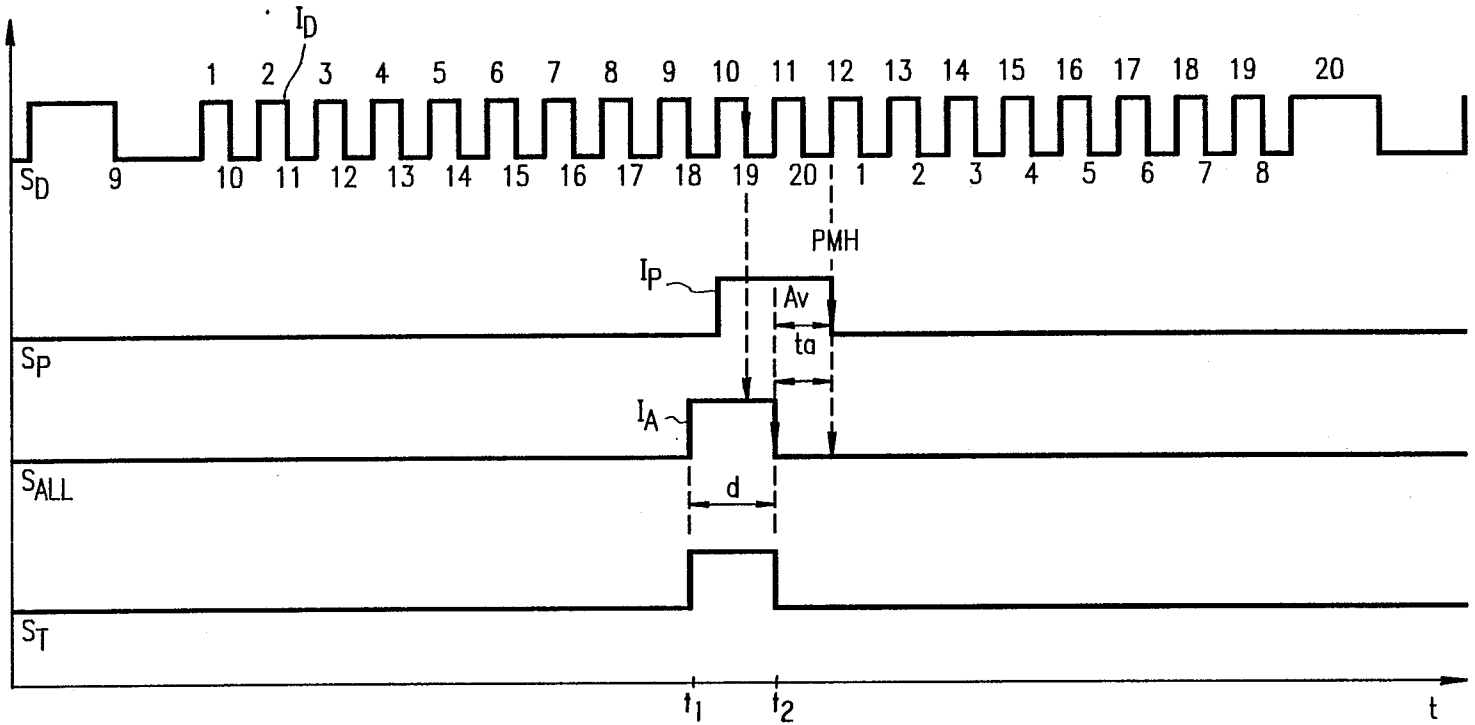
Figure 3:
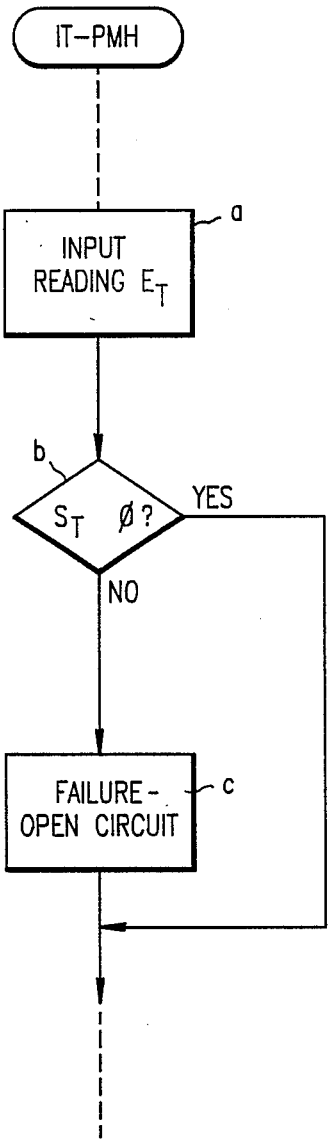
Figure 4:
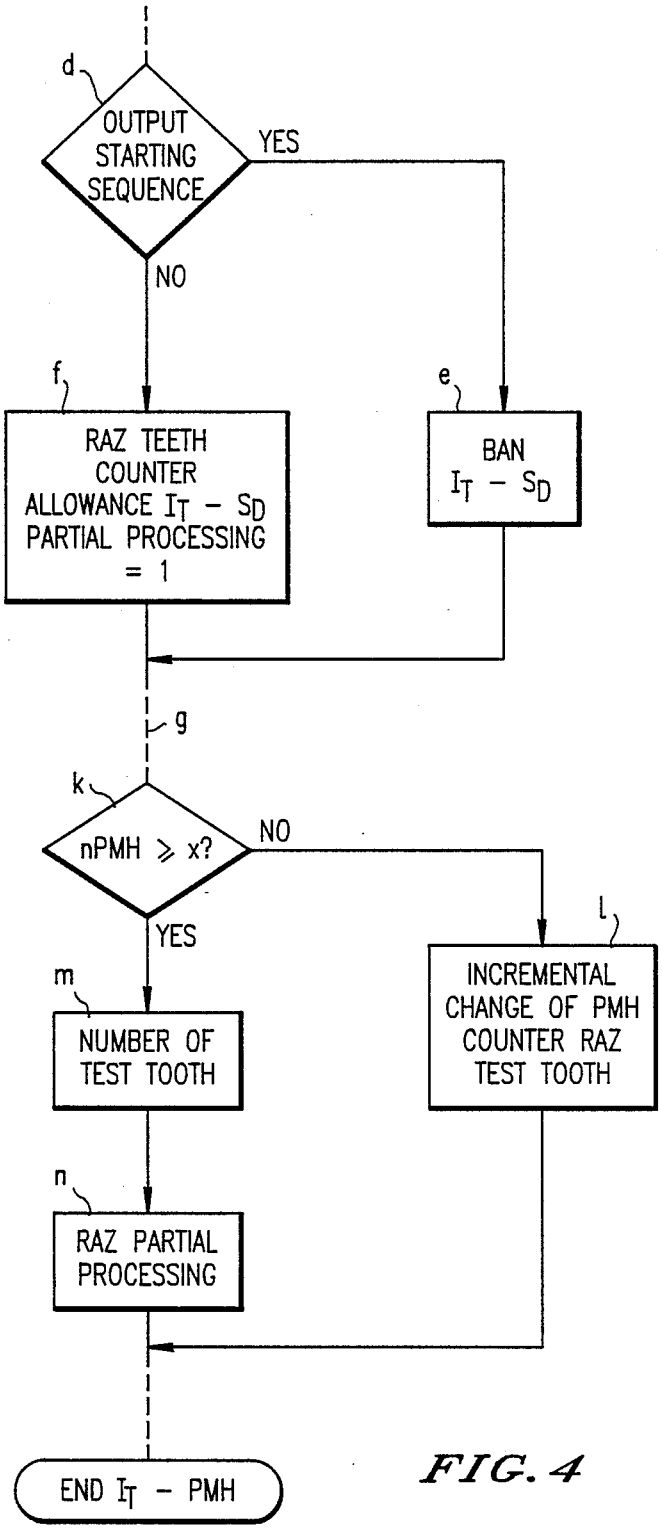
Figure 5:
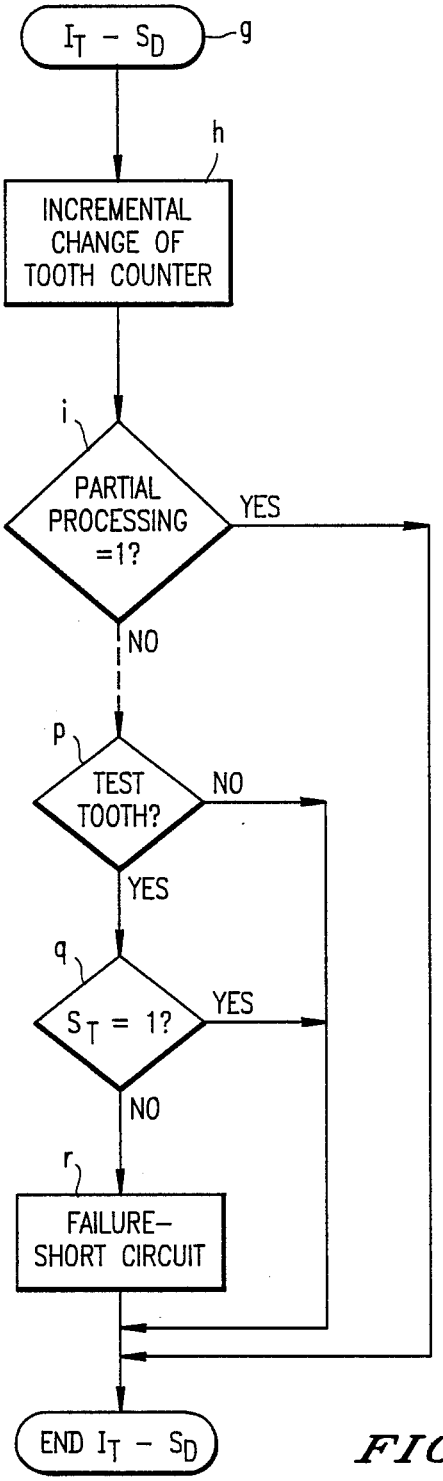

Other characteristics and advantages of the invention will comes out from the following description, illustrated by the following figures which represent:

FIG. 1: an electronic injection-ignition system comprising the device according to the invention., FIG. 2: signals SD, Sp and SALL representing respectively the electric image of the toothed target, the top dead centers (pMH) and the ignition control of the plugs;

FIGS. 3, 4 and 5: the different states of the process of verification according to an embodiment of the invention.

As FIG. 1 shows, an electronic injection-ignition system comprises in particular a gasoline supply circuit with injectors, not represented, a computer 1 assuring the computation of the ignition advance and injection time, means of acquisition of parameters influencing the computation of air-gasoline metering, and an ignition performance module 2 carrying the coil.

Ignition performance module 2 comprises a coil of slight primary impedance to make high currents pass during a very short time, an analog circuit specific to the ignition which regulates the current in the primary of the coil and a switching circuit consisting of a Darlington transistor.

One of the means of acquisition of influence parameters is a flywheel 3 comprising a target consisting of teeth $D_i$ arranged on its periphery. This flywheel is placed on the drive shaft in the vicinity of the starting ring gear. In a particular example of embodiment, this target comprises 44 teeth $D_i$ distributed uniformly of which two times two teeth are lacking to achieve an absolute indicator 5 placed 90° ahead of the top and bottom dead centers. A magnetic position sensor G, in front of which pass teeth $D_i$ of the target delivers a signal $S_C$ which is then formatted by a specific circuit 7 to supply to the microprocessor of computer 1 an electric image $S_D$ of the target, each pulse $I_D$ of signal $S_D$ corresponding to a tooth $D_i$, as well as a signal $S_p$ representative of the top dead centers, the descending front of each pulse $I_p$ corresponding to a top dead center. These signals $S_D$ and $S_p$ are represented in FIG. 2. This specific circuit 7 can be integrated or not in computer 1.

From this signal $S_D$, computer 1 determines engine speed N and the phase at the nearest degree in relation to the top dead center. It then defines the degree of ignition advance as a function of speed N, of the pressure in the manifold and other parameters such as air temperature at intake $\phi_{air}$, or the water temperature $\phi_{water}$. This degree of ignition advance $A_V$ gives the position of the ignition front of the coil. Specific circuit 7 computes the conduction time of the coil from engine speed N and voltage $U_{bat}$ delivered by the battery and sends an electric signal $S_{ALL}$ to control circuit B of the ignition performance module 2, representing (FIG. 2) a pulse sequence $I_A$ whose period d is indicative of the conduction time of the coil and whose descending front corresponds to the discharge of the coil, therefore the ignition of the corresponding plug. Interval of time $t_a$ between the descending front of pulse $I_A$ corresponding to the moment of ignition and the descending front of pulse $I_p$ corresponding to the top dead center is indicative of ignition advance $A_V$. This circuit 8 consists of a transistor T controlled to be conducting. When transistor T of circuit 8 is conducting, the signal reaching the ignition performance module is processed by its analog circuit to control the power transistor allowing the circulation of a strong current in the primary of the coil.

The invention aims at verifying the wiring of ignition performance module 2. For this purpose, a so-called test line 0 is created connecting electric connection 10 which exists between module 2 and its control circuit to test input $E_T$ of computer I with a resistance R of high value placed at the end of this test line so that the data on test line 9 is at a high level 1 when the module of power 2 is switched off.

The process of verification of the wiring of the ignition performance module consists, on one hand, in detecting an open circuit presenting itself when module 2 is switched off from its control circuit 8 and, on the other hand, in verifying that there is not a short circuit.

The process of verification of the presence of an open circuit takes place both in the starting sequence and not any moment during the operation of the engine This verification comprises different states whose sequence is represented in FIG. 3. The hierarchized program performed by injection-ignition computer 1 comprises a main part of for performing priority tasks such as the computation of the ignition advance, the opening time of injectors or the idling speed. This program is executed at each interruption called IT-top dead center, sent by specific circuit 7 to the microprocessor of computer 1 on the descending fronts of pulse $I_p$ of signal $S_p$ corresponding to the top dead centers. This program further comprises a stage (a) of reading of signal $S_T$ appearing at test input $E_T$ of the microprocessor, followed by a stage (b) of comparison of the value of this signal $S_T$ with low level 0.

Given that only an ignition advance is made and not a delay, at any working point after a top dead center, signal $S_T$ should be on low level 0 if there is no error in wiring.

If module 2 is switched off, test line 9 is connected to voltage $V_N$, equal to 5 volts, by resistance R and Signal $S_T$ is at high level 1.

At stage c, the state of the failure is indicated and a defect light can be lit. Thus to verify the wiring of ignition performance module 2 computer 1 reads the test bit of signal $S_T$ quite rapidly after a top dead center. Then the main program of the computer continues.

In the case it has been verified in the starting sequence that the module is not in open circuit, it must then be verified that there is no short circuit, i.e. that module 2 is not grounded. To avoid problems due to the shift between the value of ignition advance computed by the microprocessor and the value of advance actually applied to a given moment, this verification will be performed only at the starting sequence, i.e. when the starter is under voltage and engine speed N is less than a threshold. The invention proposes to verify that the level of signal $S_T$ of test line 9 indeed passes to high level 1 between moment $t_1$ when the coil and the moment of ignition $t_2$ are made conducting. Given the possible variations of time of conduction d of the coil which is unknown for computer 1, it is necessary to make the test as close as possible to the moment of ignition $t_2$ which is known since it is computed by the microprocessor from the synchronization of top dead centers and ignition advance parameters.

The process of verification of the presence or not of a short circuit in the connection of the ignition performance module is performed as follows.

At the beginning of the main program executed by computer 1, it is first verified that the engine is indeed in the starting sequence. If this first condition is not met, the short circuit test will not be made. On the other hand, this condition being met, a second condition is necessary: the number of top dead centers $n_{PMH}$ identified since turning on the engine should be equal to or greater than a threshold x (x=5 for example). Actually, if this number $n_{PMH}$ is less than the determined threshold, the microprocessor of computer 1 has not yet had the time to compute a value of advance ignition and that which is then delivered to ignition performance module 9 is that programmed in specific circuit 7.

These two conditions—starting sequence and $n_{PMH}$ equal to or greater than a threshold—then being met, tooth $D_i$ of flywheel 3, on which will be made the test, is determined.

According to an original characteristic of the invention, this tooth is obtained by taking the entire part of the fraction:

$$d_{20} - \frac{A_V + \frac{d_i}{2}}{d_i}$$

with $A_V$ the degree of ignition advance;

$d_i$ the number of driving degrees corresponding to the period of a tooth $D_i$ of the target, and $d_{20}$ the number of the 20th tooth corresponding to a top dead center.

In a four-cylinder engine, the period of a tooth is 8°, ignition advance by starter is for example 8° and a top dead center appears on the twentieth tooth so that the tooth on which the verification of the short circuit will be performed is tooth 19.

Once tooth $D_i$, on which the test of the short circuit should be performed, is determined, the main program of computer 1 continues, then comprising allowance of being interrupted by signal $S_D$ corresponding to teeth $D_i$ of target 3.

When an interruption IT−$S_D$ by signal $S_D$ occurs, computer 1 will interrupt its main program and executes an interruption program during which it should first read the number of tooth $D_i$ identified by sensor 6 then compare it with the number determined of the test tooth and in case of coincidence, it will read the level of signal $S_T$ terminating at input ET of the microprocessor. If the signal is at low level 0, contrary to ignition control signal $S_{ALL}$ which is at 1, this proves that the ignition performance module 2 is grounded and the state of the failure should be indicated.

FIGS. 4 and 5 represent the stages of the process of verification of a short circuit, according to a particular nonlimiting embodiment.

In the main program of computer 1, at the beginning of a top dead center interruption, it is verified at stage (d) whether the starting sequence is ended, in which case the verification of the short circuit can not be made and interruptions IT−SD of the main program of computer 1, caused by pulses $I_D$ of signal $S_D$ at each passage of a tooth $D_i$ in front of sensor 8, are therefore not allowed, at stage (e).

On the other hand, if the engine is still under the starter, the main program performs stage (f) during which first the counter of teeth $D_i$, existing in computer 1, is reinitialized at 0, second, interruptions IT−SD of the program by teeth signal $S_D$ are allowed and finally, value 1 is given to a partial processing indicator, called IT−SD processing Flag, located in the memory of the computer. Then the main program continues.

If an interruption IT−SD caused by teeth signal $S_D$ occurs, for example at stage (g), the computer performs the interruption program represented in FIG. 5, and comprising stage (h) of incrementation of the counter of teeth, then stage (i) of reading the value of the partial processing indicator, IT−SD processing Flag.

At this moment of the main program, the value of the indicator is at 1 and the verification of the short circuit is not made.

If there are no interruptions IT−SD, the program of the computer performs stage (k) consisting in comparing the number of top dead centers $n_{PMH}$ identified since turning on the engine with a determined threshold x. If this number $n_{PMH}$ is less than x (x=5, for example), it is known that the microprocessor has not yet had time to compute a value of ignition advance and that which is delivered to ignition performance module 2 is that programmed in specific circuit 7. In this case, it is decided not to make the test of the short circuit yet and stage (l) consists, on one hand, in incrementing the counter of top dead centers existing in computer 1 and, on the other hand, in giving a nonexistent value to the test tooth not to make this test.

If the number of top dead centers $n_{PMH}$ is equal to or greater than threshold x, tooth $D_i$ of flywheel 3 on which the test will be made is determined at stage (m), according to the formula previously stated.

Once this stage (m) is performed, the main program of the computer continues at stage (n) of resetting to zero the partial processing indicator allowing the verification of the short circuit when an interruption IT−SD by signal $S_D$ arrives.

In such a case of interruption IT−SD, the computer will execute interruption program IT−SD in FIG. 5 in which it is oriented toward stage (g). At stage (i), the IT−SD processing Flag indicator is at 0 so that the program continues by stage (p) of reading of tooth $D_i$ identified by sensor G. If this tooth $D_i$ is not the tooth on which the test should be made, said test is not made and a new interruption of teeth signal $S_D$ is awaited to make it.

If, on the other hand, the test tooth is identified, at stage (q), the level of signal $S_T$ terminating at input $E_T$ of the microprocessor is read: if the signal is at low level 0, contrary to the ignition control signal $S_{ALL}$ which is at 1, this proves that ignition performance module 2 is grounded and at stage (r) the state of is indicated with lighting a failure light if necessary.

Thanks to the invention, the open circuits and grounded short circuits on the control wire of the ignition performance module can be detected, avoiding the wasteful replacements of the module.

We claim:

1. An ignition and injection control device for an internal combustion engine, comprising:

a magnetic sensor placed near a flywheel of said internal combustion engine to sense rotational movement;

a computer having an input for receiving the output of said magnetic sensor and other inputs for receiving signals indicative of other parameters of said internal combustion engine, said computer computing the ignition advance and injection timing for the internal combustion engine;

an ignition performance module connected to the ignition of said internal combustion engine;

a control circuit connected to said ignition performance module by a control line, said control circuit receiving a signal from said computer and in response thereto controlling said ignition performance module to fire said ignition;

a test line connecting said control line with a test input of said computer in order to test the writing of the ignition performance module for short circuits and open circuits,

2. An ignition and injection control method for an internal combustion engine including an ignition performance module, a control circuit connected to said ignition performance module by a control line, a computer for providing a signal to said control circuit, a test line connecting said control line to said computer, and a magnetic sensor sensing the teeth on a flywheel, comprising the steps of:

reading at each top dead center, a signal appearing on said test line;

comparing said signal with a low level reference;

detecting an open circuit between said ignition performance module and the control circuit when said signal is greater than said reference;

indicating an open circuit failure.

3. A control method according to claim 2, further comprising, the steps of:

determining that the engine is in a starting sequence;

determining that the number of top dead centers appearing after the initiation of the starter exceeds a threshold;

determining at which tooth of the flywheel a test is to made;

reading the signal on said test line by said computer when the determined tooth is in position;

detecting a short circuit when said signal is at a low level;

indicating a short circuit failure.

4. A control method according to claim 3, wherein the step of determining at which tooth a test is made includes the step of determining the value of $$d_{20} - \frac{Av + \frac{d_i}{2}}{d_i}$$

where $A_v$ is the degree of ignition advance; $d_i$ is the number of degrees corresponding to the period of a tooth and $d_{20}$ is the number of the tooth corresponding to top dead center.

* * * * *